US005658400A

United States Patent [19]

Uchino et al.

[11] Patent Number: 5,658,400

[45] Date of Patent: Aug. 19, 1997

[54] RAILS OF PEARLITIC STEEL WITH HIGH WEAR RESISTANCE AND TOUGHNESS AND THEIR MANUFACTURING METHODS

[75] Inventors: Kouichi Uchino; Toshiya Kuroki; Masaharu Ueda, all of Kitakyushu, Japan

[73] Assignee: Nippon Steel Corporation, Tokyo, Japan

[21] Appl. No.: 507,352

[22] PCT Filed: Dec. 19, 1994

[86] PCT No.: PCT/JP94/02137

§ 371 Date: Aug. 15, 1995

§ 102(e) Date: Aug. 15, 1995

[87] PCT Pub. No.: WO95/17532

PCT Pub. Date: Jun. 29, 1995

[30] Foreign Application Priority Data

| | | | |
|---|---|---|---|
| Dec. 20, 1993 | [JP] | Japan | 5-320098 |
| Oct. 7, 1994 | [JP] | Japan | 6-244440 |
| Oct. 7, 1994 | [JP] | Japan | 6-244441 |

[51] Int. Cl.[6] ..... C21D 8/00; C21D 9/04; C22C 38/02

[52] U.S. Cl. ..... 148/333; 148/584; 148/902; 148/334

[58] Field of Search ..... 148/584, 333, 148/334, 902

[56] References Cited

U.S. PATENT DOCUMENTS

| | | | |
|---|---|---|---|
| 3,726,724 | 4/1973 | Davies et al. . | |
| 4,486,248 | 12/1984 | Ackert et al. . | |
| 4,714,500 | 12/1987 | Heller et al. . | |
| 4,767,475 | 8/1988 | Fukuda et al. | 148/335 |

FOREIGN PATENT DOCUMENTS

| | | | |
|---|---|---|---|
| 0358362 | 3/1990 | European Pat. Off. . | |
| 0469560 | 2/1992 | European Pat. Off. . | |
| 3111420 | 10/1982 | Germany . | |
| 47-7606 | 4/1972 | Japan . | |
| 51-2616 | 1/1976 | Japan . | |
| 55-2768 | 1/1980 | Japan . | |
| 57-198216 | 12/1982 | Japan | 148/584 |
| 58-221229 | 12/1983 | Japan . | |
| 59-133322 | 7/1984 | Japan . | |
| 62-99438 | 5/1987 | Japan . | |
| 63-277721 | 11/1988 | Japan . | |
| 2118579 | 11/1983 | United Kingdom | 148/584 |
| WO-A-9314230 | 7/1993 | WIPO . | |

*Primary Examiner*—Deborah Yee
*Attorney, Agent, or Firm*—Kenyon & Kenyon

[57] ABSTRACT

High-carbon pearlitic steel rails have high strength, wear resistance, ductility and toughness are manufactured by applying special rolling to produce fine-grained pearlite blocks in steels containing 0.60 to 1.20% carbon, 0.10 to 1.20 % silicon, 0.40 to 1.50% manganese and one or more elements selected, as required, from the group of chromium, molybdenum, vanadium, niobium and cobalt, thus imparting high wear resistance and an elongation of not less than 12% and a V notch Charpy impact value of not lower than 25 J/cm$^2$. The high-carbon rails having high wear resistance, ductility and toughness assure safe railroad services in cold districts.

12 Claims, 1 Drawing Sheet

RAILS OF PEARLITIC STEEL WITH HIGH WEAR RESISTANCE AND TOUGHNESS AND THEIR MANUFACTURING METHODS

FIELD OF THE INVENTION

This invention relates to rails with high toughness of high-carbon pearlitic steels having high strength and wear resistance intended for railroad rails and industrial machines and their manufacturing processes.

DESCRIPTION OF THE PRIOR ART

Because of high strength and wear resistance, high-carbon steels with pearlitic structures are used in structural applications, for railroad rails required to withstand heavier axial loads due to increases in the weight of railroad cars and intended for faster transportation.

Many technologies for manufacturing high-performance rails have been known. Japanese Provisional Patent Publication No. 55-2768 (1980) discloses a process of manufacturing hard rails by cooling heated steel having a special composition that is liable to produce a pearlitic structure from above the $Ac_3$ point to between 450° and 600° C., thereby producing a fine pearlitic structure through isothermal transformation. Japanese Provisional Patent Publication No. 58-221229 (1983) discloses a process of heat treatment for producing rails with improved wear resistance that produces fine pearlite by quenching a heated rail containing 0.65 to 0.85% carbon and 0.5 to 2.5% manganese, thereby producing fine pearlite in the rail or the head thereof. Japanese Provisional Patent Publication No. 59-133322 (1984) discloses a process of heat treatment for producing rails with a fine pearlitic structure having a hardness of Hv>350 and extending to a depth of approximately 10 mm from the surface of the rail head by immersing a rolled rail having a special composition that forms a stable pearlitic structure and heated to a temperature above the $Ar_3$ point in a bath of molten salt of a certain Specific temperature.

Although pearlitic steel rails of desired strength and wear resistance can be readily produced by adding appropriate alloying elements, their toughness is much lower than that of steels consisting essentially of ferritic structures. In tests made on V notch Charpy test specimens No. 3 according to JIS at normal temperatures, for example, rails of eutectoid carbon steels with a pearlitic structure exhibit a toughness of approximately 10 to 20 J/cm$^2$ and those of steels containing carbon above the eutectoid point exhibit a toughness of approximately 10 J/cm$^2$. Tensile specimens No. 4 according to JIS exhibit an elongation of less than 10%. When steels having such low toughness are used in structural applications subject to repeated loading and vibration, fine initial defects and fatigue cracks can lead to brittle fractures at low stresses.

Generally, toughness of steel is improved by grain refinement of the metal structure or, more specifically, by refinement of austenite grains or transgranular transformation. Refinement of austenite grains is accomplished by application of low-temperature heating during or after rolling, or a combination of controlled rolling and heating treatment as disclosed in Japanese Provisional Patent Publication No. 63-277721 (1988). In the manufacture of rails, however, low-temperature heating during rolling, controlled rolling at low temperatures and heavy-draft rolling are not applicable because of formability limitations. Even today, therefore, toughness is improved by conventional heating treatment at low temperatures. Still, this process involves several problems, such as costliness and lower productivity, requiring prompt solutions to make itself as efficient as the latest technologies that provide greater energy and labor savings and higher productivity.

The object of this invention is to solve the problem described above. More specifically, the object of this invention is to provide rails with improved wear resistance, ductility and toughness and processes for manufacturing such rails by eliminating the problems in the conventional controlled rolling processes dependent upon low temperatures and heavy drafts, and applying a new controlled rolling process to control the grain size of the pearlite in eutectoid steels or carbon steels above the eutectoid point.

SUMMARY OF THE INVENTION

The inventors found the following from many experiments on the composition and manufacturing process of fine-grained pearlitic steels with improved toughness. Rails are generally required to have high wear resistance in the head and high bending fatigue strength and ductility in the base. Rails with good wear resistance, ductility and toughness can be obtained by making the carbon content in the rail head and base eutectoid or hypereutectoid and controlling the size of fine-grained pearlite blocks. When rolled in the austenitic state, high-carbon steels recrystallize immediately even after rolling at relatively low temperatures and with light drafts. Fine-grained uniformly sized austenite grains that form a fine-grained pearlitic structure can be obtained by applying continuous rolling with light drafts and more closely spaced rolling passes than before to the steels just described.

Here, the pearlite block is made up of an aggregate of pearlite colonies with the same crystal and lamella orientation, as shown in FIG. 1. The lamella is a banded structure consisting of layers of ferrite and cementite. When fracturing, each pearlite grain breaks into pearlite blocks.

Based on the above finding, this invention provides:

Rails of carbon steel or low-alloy steels having high toughness, high wear resistance, and pearlitic structures consisting of 0.60 to 1.20% carbon, 0.10 to 1.20% silicon, 0.40 to 1.50% manganese, and, as required, one or more of 0.05 to 2.00% chromium, 0.01 to 0.30% molybdenum, 0.02 to 0.10% vanadium, 0.002 to 0.01% niobium and 0.1 to 2.0% cobalt, by weight, with the remainder consisting of iron and unavoidable impurities, the grain diameter of pearlite blocks averaging 20 to 50 μm in a part up to within at least 20 mm from the top surface of the rail head and in a part up to within at least 15 mm from the surface of the rail base and 35 to 100 μm in other parts, having an elongation of not less than 10% and a V notch Charpy impact value of not less than 15 J/cm$^2$ in the part where the grain diameter of pearlite blocks averages 20 to 50 μm; and Processes for manufacturing high toughness rails with pearlitic structures by improving mechanical properties, particularly ductility and toughness, by the control of the size of pearlite blocks that is achieved by applying three or more passes of continuous finish rolling at intervals of not more than 10 seconds to semifinished rails roughly rolled from billets of carbon or low-alloy steels of the above composition while the surface temperature thereof remains between 850° and 1000° C., with a reduction in area of 5 to 30% per pass, and then allowing the finish-rolled rails to cool spontaneously or from above 700° C. to between 700° and 500° C. at a rate of 2° to 15° C. per second.

In particular, carbon and low-alloy steels containing 0.60 to 0.85% carbon, by weight, exhibit higher toughness, with an elongation of 12% or above and a V notch Charpy impact value of 25 J/cm$^2$ in the part where the grain diameter of pearlite blocks averages 20 to 50 μm, while carbon and low-alloy steels containing 0.85 to 1.20% by weight carbon exhibit higher wear resistance.

DESCRIPTION OF THE PREFERRED EMBODIMENTS

Figure 1:
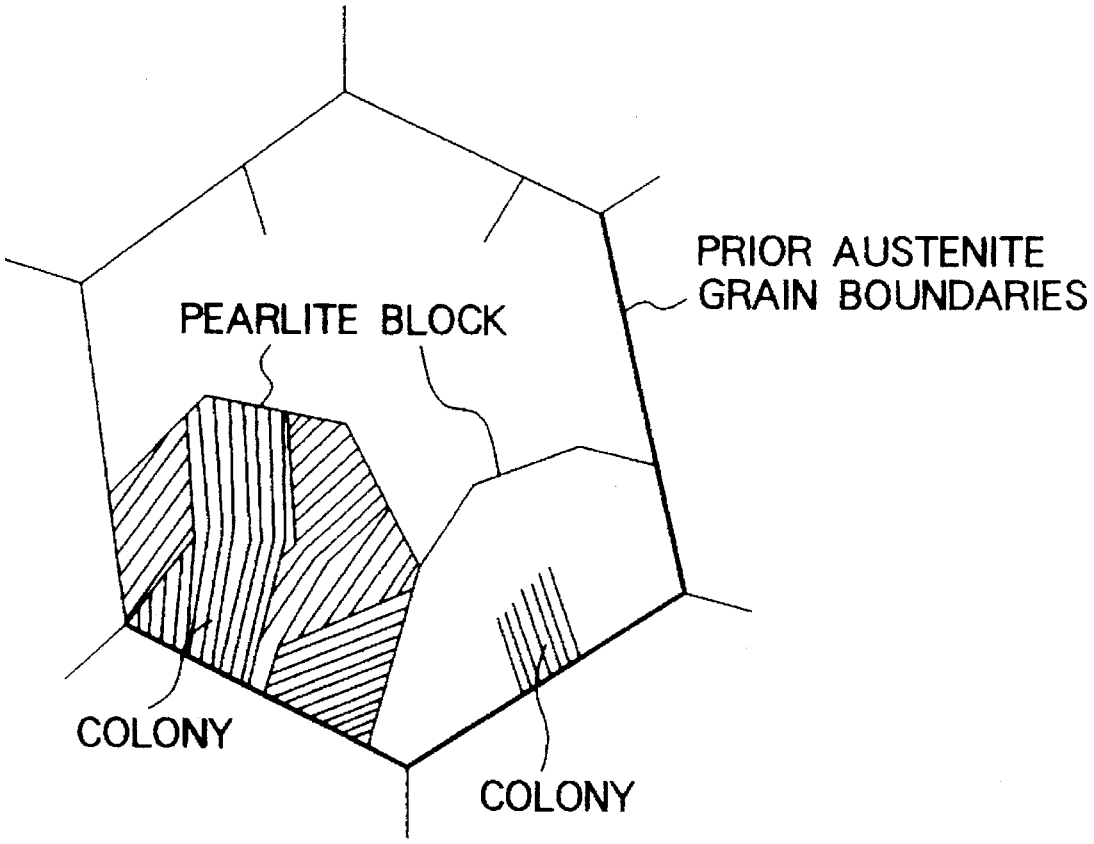
FIG. 1 is a schematic illustration of a crystal grain of pearlite.

Details of this invention are described in the following.

The reason for limiting the composition of steel as described before will be discussed first.

Carbon: Carbon imparts wear resistance to steel by producing pearlitic structures. Usually, rail steels contain 0.60 to 0.85% carbon in order to obtain high toughness. Sometimes, proeutectoid ferrite is formed at austenite grain boundaries. To improve wear resistance and inhibit the initiation of fatigue damage in rails, it is preferable for rail steels to contain 0.85% or more of carbon. The quantity of proeutectoid cementite at austenite grain boundaries increases with increasing carbon content. When carbon content exceeds 1.2%, deterioration in ductility and toughness becomes uncontrollable even by the grain refinement of pearlitic structures that is described later. Hence, carbon content is limited to between 0.60 and 1.20%.

Silicon: The content of silicon, which strengthens the ferrite in pearlitic structures, is 0.1% or above. However, silicon in excess of 1.20% embrittles steel by producing martensitic structures. Hence, silicon content is limited to between 0.10 and 1.20%.

Manganese: Manganese not only strengthens pearlitic structures but also suppresses the production of proeutectoid cementite by lowering the pearlite transformation temperature. Manganese below 0.40% does not produce the desired effects. Conversely, manganese in excess of 1.50% embrittles steel by producing martensitic structures. Therefore, manganese content is limited to between 0.40 and 1.50%.

Chromium: Chromium raises the equilibrium transformation temperature of pearlite and, as a consequence, refines the grain size of pearlitic structures and suppresses the production of proeutectoid cementite. Chromium is therefore selectively added as required. While not producing satisfactory results when its content is below 0.05%, manganese embrittles steel by producing martensitic structures when its content exceeds 2.0%. Thus, chromium content is limited to between 0.05 and 2.00%.

Molybdenum and Niobium: Molybdenum and niobium, which strengthen pearlite, are selectively added as required. Molybdenum below 0.01% and niobium below 0.002% do not produce the desired effects. On the other hand, molybdenum over 0.30% and niobium over 0.01% suppress the recrystallization of austenite grains during rolling, which is preferable to the grain refining of metal structures, form elongated coarse austenite grains, and embrittles pearlitic steels. Therefore, molybdenum and niobium contents are limited to between 0.01 and 0.30% and between 0.002 and 0.01%, respectively.

Vanadium and Cobalt: Vanadium and cobalt strengthening pearlitic structures are selectively added between 0.02 and 0.1% and between 0.10 and 2.0%. Addition below the lower limits does not produce sufficient strengthening effects, while addition in excess of the upper limits produce excessive strengthening effects.

This invention is based on eutectoid or hypereutectoid steels whose austenite exhibits a recrystallization behavior characteristic of high-carbon steels. Any of the alloying elements described before may be added as required so long as the metal structure remains pearlitic.

The range in which the grain size of pearlite blocks averages 20 to 50 μm is limited to a part up to within 20 mm from the surface of the rail head and up to within 15 mm from the surface of the rail base for the following reason. Damages caused by the contact of the rail head with the wheels of running trains are confined to a part up to within 20 mm from the surface of the rail head, whereas those caused by the tensile stress built up at the rail base are confined to a part up to within 15 mm from the surface thereof.

The average grain size of pearlite blocks in the rail head and base is limited to between 20 and 50 μm because the grains finer than 20 μm do not provide high enough hardness to obtain the wear resistance required of rails, while those coarser than 50 μm bring about a deterioration in ductility and toughness.

The average grain size of pearlite blocks in other parts than the rail head and base is limited to between 35 and 100 μm because the grains finer than 35 μm do not provide the strength required of rail steels while those coarser than 100 μm deteriorate the ductility and toughness thereof.

The reason why the elongation and V notch Charpy impact value of the portions of the rail in which the grain size of pearlite blocks averages 20 to 50 μm are limited to not less than 10% and not lower than 15 J/cm$^2$ is as follows: Rails with an elongation below 10% and V notch Charpy impact value below 15 J/cm$^2$ cannot cope with the longitudinal strains and impacts imposed by the trains running thereover and might develop cracks over long periods of time. With rail steels containing 0.60 to 0.85% by weight of carbon, elongation and V notch Charpy impact value may be increased to 12% or above and 25 J/cm$^2$ or above, thus providing high toughness than that of conventional rails.

Processes for manufacturing rails having the above compositions and characteristics are described below.

Billets of carbon steels cast from liquid steel prepared in an ordinary melting furnace through a continuous casting or an ingot casting route or those of low-alloy steels containing small amounts of chromium, molybdenum, vanadium, niobium, cobalt and other strength and toughness increasing elements are heated to 1050° C. or above, roughly rolled into rail-shaped semifinished products, and then continuously finished into rails. Though not specifically limited, the temperature at which breakdown rolling is finished should preferably be not lower than 1000° C. in order to provide good formability. Continuous finish rolling that finishes a breakdown into a rail of final size and shape start at the temperature at which breakdown rolling was finished, reducing the cross-section by 5 to 30% per pass while the surface temperature of the rail remains 850° to 1000° C.

Continuous finish rolling under the above conditions is necessary to produce austenitic structures of uniformly sized fine grains that are essential for the production of fine-grained pearlitic structures. Because of higher carbon contents, (1) fine-grained austenitic structures can readily recrystallize at lower temperatures and with lower reductions, (2) recrystallization will be completed quickly after rolling, and (3) recrystallization repeats each time rolling is applied even if the amount of reduction is small, thus suppressing the grain growth in austenitic structures.

As the growth of pearlite initiates from austenite grain boundaries, austenite grains must be refined in order to reduce the size of pearlite blocks. Austenite grains are refined by hot-working steels in the austenite temperature range. As austenite grains recrystallize each time hot working is repeated, grain refinement is achieved by repeating hot working or increasing the reduction rate. On the other hand, rolling time intervals must be reduced as the growth of austenite grains begin shortly after rolling.

The rails finished by this continuous finish rolling of this invention have a surface temperature is between 850° and 1000° C. If the finishing temperature is lower than 850° C., austenitic metal structures remain unrecrystallized, with the formation of fine-grained pearlitic metal structures prevented. Finish rolling at temperatures above 1000° C. causes the growth of austenite grains and then forms coarse-grained austenitic metal structures during the subsequent pearlite transformation, as a result of which the production of uniformly sized fine pearlite grains is again prevented.

A reduction in area of 5 to 30% per pass produces fine-grained austenitic metal structures. Lighter reductions under 5% do not provide large enough strain hardening to cause recrystallization of austenitic metal structures. Heavier reductions over 30%, in contrast, present difficulty in rail forming. To facilitate the production of fine-grained austenitic metal structures with a reduction in area of not more than 30%, rolling must be performed in three or more passes so that the recrystallization and grain growth of austenitic metal structures are suppressed.

Between the individual passes in the rolling operation, austenite metal structures grow to produce coarser grains that deteriorate the strength, toughness and other properties required of rails because of the heat retained therein. Accordingly, this invention reduces the time interval between the individual passes to not longer than 10 seconds. Continuous finish rolling comprising passes at short intervals is conducive to the attainment of fine-grained of austenitic metal structures which, in turn, leads to the production of fine-grained pearlitic metal structures. The time interval between the passes of ordinary reversing-mill rolling is from approximately 20 to 25 seconds. This time interval is long enough to allow the grain size of austenitic metal structures to grow to such an extent that relief of strains, recrystallization and grain growth are possible. Then, the effect of rolling-induced recrystallization to cause grain refinement will be marred so seriously that the manufacture of rail steels having fine-grained pearlite blocks becomes impossible. This is the reason why the time intervals between the rolling passes must be reduced to a minimum. The rails thus finished to the desired shape and size under the rolling conditions described above and still hot are allowed to cool naturally in the air to lower temperatures.

When high strength is required, rails after continuous finish rolling are cooled from above 700° C., where transformation-induced strengthening can take place, to a temperature range between 700° and 500° C. in which the cooling rate of steel affects its transformation, at a rate of 2° to 15° C. per second. A cooling rate slower than 2° C. per second does not provide the desired strength because the resulting transformation-induced strengthening is analogous to that which results from natural cooling in the air. A cooling rate faster than 2° C. per second, on the other hand, produces bainite, martensite and other structures that greatly impair the toughness of steel and thereby lead to the production of brittle rails.

As is obvious from the above, the manufacturing processes of this invention permit imparting higher toughness to rails through the production of fine-grained pearlitic metal structures.

[EXAMPLES]

Table 1 shows the chemical compositions of test specimens with pearlitic metal structures. Table 2 shows the heating and finish rolling conditions applied to the steels of the compositions given in Table 1 in the processes of this invention and the conventional processes tested for comparison. Table 3 shows the conditions for post-rolling cooling.

Table 4 lists the mechanical properties of the rails manufactured by the processes of this invention and the conventional processes tested for comparison by combining the steel compositions, rolling and cooling conditions shown in Tables 1 to 3.

The rails manufactured by the processes of this invention exhibited significantly higher ductilities and toughness (2UE+20° C.) than those manufactured by the conventional processes, with strength varying with the compositions and cooling conditions.

TABLE 1

| Steel | C | Si | Mn | Cr | Mo | V | Nb | Co |
|---|---|---|---|---|---|---|---|---|
| A | 0.62 | 0.20 | 0.90 | — | — | — | — | — |
| B | 0.80 | 0.50 | 1.20 | 0.20 | — | 0.05 | — | — |
| C | 0.75 | 0.80 | 0.80 | 0.50 | — | — | 0.01 | 0.10 |
| D | 0.83 | 0.25 | 0.90 | 1.20 | 0.20 | — | — | — |
| E | 0.86 | 0.20 | 0.70 | — | — | — | — | — |
| F | 0.90 | 0.50 | 1.20 | 0.50 | — | 0.05 | 0.01 | 0.10 |
| G | 1.00 | 0.50 | 1.00 | — | 0.20 | — | — | — |
| H | 1.19 | 0.20 | 0.90 | — | — | — | — | — |

TABLE 2

| | Heating | Finish Rolling Conditions | | | | | |
|---|---|---|---|---|---|---|---|
| | | First Pass | | | Second Pass | | |
| Designation | Temperature °C. | Temperature °C. | Reduction Rate % | Interval (Second) | Temperature °C. | Reduction Rate % | Reduction (Second) |
| Processes of This Invention | | | | | | | |
| a | 1250 | 1000 | 25 | 1 | 1000 | 5 | 5 |
| b | 1250 | 950 | 25 | 1 | 950 | 5 | 5 |
| c | 1250 | 900 | 25 | 1 | 900 | 5 | 5 |
| Conventional Processes | | | | | | | |
| d | 1250 | 1000 | 25 | 1 | 1000 | 5 | 25 |
| e | 1250 | 950 | 25 | 1 | 950 | 5 | 25 |

TABLE 2-continued

| | | Finish Rolling Conditions | | | | |
|---|---|---|---|---|---|---|
| | Heating | Third Pass | | | Fourth Pass | |
| Designation | Temperature °C. | Temperature °C. | Reduction Rate % | Interval (Second) | Temperature °C. | Reduction Rate % |
| Processes of This Invention | | | | | | |
| a | 1250 | 995 | 15 | 1 | 995 | 5 |
| b | 1250 | 945 | 15 | 1 | 945 | 5 |
| c | 1250 | 895 | 15 | 1 | 895 | 5 |
| Conventional Processes | | | | | | |
| d | 1250 | 980 | 15 | 1 | 980 | 5 |
| e | 1250 | 930 | 15 | 1 | 930 | 5 |

TABLE 3

| Designation | Cooling Start Temperature °C. | Cooling Rate °C./S |
|---|---|---|
| I | 800 | 2 |
| II | 800 | 4 |
| III | 720 | 10 |
| IV | 680 | 12 |

What is claimed is:

1. A pearlitic steel rail of high wear resistance and toughness having a pearlitic structure consisting, by weight, of 0.60 to 1.20% carbon, 0.10 to 1.20% silicon, 0.40 to 1.50% manganese, with the remainder consisting of iron and unavoidable impurities, the grain diameter of pearlite blocks averaging 20 to 50 μm in a part within at least 20 mm from the top surface of the rail head and in a part within at least 15 mm from the surface of the rail base and 35 to 100 μm in other parts, having an elongation of not less than 10% and a V notch Charpy impact value of not less than 15 J/cm$^2$ in the part where the grain diameter of pearlite blocks averages 20 to 50 μm.

2. A pearlitic steel rail of high wear resistance and toughness having a pearlitic structure consisting, by weight, of 0.60 to 1.20% carbon, 0.10 to 1.20% silicon, 0.40 to 1.50% manganese, and one or more elements selected from the group of 0.05 to 2.00% chromium, 0.01 to 0.30% molybdenum, 0.02 to 0.10% vanadium, 0.002 to 0.01%

TABLE 4

| Reference No. | Steel | Rolling Process | Cooling Method | Tensile Strength (MPa) | Hardness (Hv10) | Ductility (%) | 2UE + 20° C. (J/cm$^2$) | Mean Diameter of Pearlite Block in Rail Head and Base (μm) | Amount of Wear/ 500,000 Times of of Rolling Over (g) |
|---|---|---|---|---|---|---|---|---|---|
| Processes of This Invention | | | | | | | | | |
| 1 | A | a | A.C. | 930 | 285 | 14 | 26 | 42 | — |
| 2 | B | b | I | 1210 | 365 | 16 | 33 | 28 | — |
| 3 | B | b | III | 1290 | 395 | 17 | 43 | 29 | — |
| 4 | D | b | A.C. | 1100 | 335 | 13 | 28 | 31 | — |
| 5 | C | a | II | 1280 | 390 | 15 | 32 | 43 | — |
| 6 | B | c | III | 1260 | 380 | 17 | 45 | 22 | — |
| 7 | E | a | A.C. | 920 | 280 | 11 | 16 | 48 | 0.65 |
| 8 | E | b | II | 1150 | 345 | 12 | 19 | 28 | 0.20 |
| 9 | F | a | A.C. | 1050 | 320 | 11 | 17 | 41 | 0.30 |
| 10 | F | b | I | 1310 | 400 | 15 | 24 | 39 | 0.02 |
| 11 | G | a | A.C. | 1040 | 315 | 10 | 17 | 46 | 0.40 |
| 12 | G | b | II | 1280 | 390 | 14 | 22 | 29 | 0.03 |
| 13 | G | c | III | 1340 | 410 | 15 | 23 | 21 | 0.01 |
| 14 | H | b | I | 1335 | 410 | 12 | 16 | 31 | 0.02 |
| Conventional Processes | | | | | | | | | |
| 15 | A | d | A.C. | 940 | 285 | 10 | 16 | 123 | — |
| 16 | B | d | I | 1200 | 365 | 11 | 16 | 120 | — |
| 17 | E | d | A.C. | 930 | 285 | 7 | 5 | 122 | 1.10 |
| 18 | G | e | II | 1300 | 395 | 9 | 9 | 95 | 0.20 |
| 19 | B | d | IV | 1100 | 335 | 11 | 15 | 122 | — |

A.C.: Air Cooling

USE IN INDUSTRIAL APPLICATIONS

As will be obvious from the above, the rails manufactured by the processes of this invention under specific finish rolling and cooling conditions have fine-grained pearlitic structures that impart high wear resistance and superior ductility and toughness. The rails according to this invention thus prepared are strong enough to withstand the increasing load and speed of today's railroad services.

niobium and 0.1 to 2.0% cobalt, with the remainder consisting of iron and unavoidable impurities, the grain diameter of pearlite blocks averaging 20 to 50 μm in a part within at least 20 mm from the top surface of the rail head and in a part within at least 15 mm from the surface of the rail base and 35 to 100 μm in other parts, having an elongation of not less than 10% and a V notch Charpy impact value of not less than 15 J/cm$^2$ in the part where the grain diameter of pearlite blocks averages 20 to 50 μm.

3. A pearlitic steel rail of high wear resistance according to claim 1, in which carbon content is limited to between over 0.85% and 1.20% by weight.

4. A pearlitic steel rail of high toughness according to claim 1, in which carbon content is limited to between 0.60 and 0.85% by weight, with an elongation of not less than 12% and a V notch Charpy impact value of not less than 25 J/cm$^2$ in the part where the grain diameter of pearlite blocks averages 20 to 50 μm.

5. A process for manufacturing a pearlitic steel rail of high wear resistance and toughness comprising the steps of roughing a billet of carbon or low-alloy steel containing, by weight, 0.60 to 1.20% carbon, 0.10 to 1.20% silicon, 0.40 to 1.50% manganese, and one or more elements selected from the group of 0.05 to 2.00% chromium, 0.01 to 0.30% molybdenum, 0.02 to 0.10% vanadium, 0.002 to 0.01% niobium and 0.1 to 2.0% cobalt, into a semi-finished breakdown, continuously finish rolling the breakdown while the surface temperature thereof remains between 850° and 1000° C. by giving three or more passes, with a reduction rate of 5 to 30% per pass and a time interval of not longer than 10 seconds between the individual passes, and allowing the finished rail to cool naturally in the air, thereby adjusting the grain size of the pearlite blocks and the mechanical properties of the rail.

6. A process for manufacturing a pearlitic steel rail of high wear resistance and toughness comprising the steps of roughing a billet of carbon or low-alloy steel containing, by weight, 0.60 to 1.20% carbon, 0.10 to 1.20% silicon, 0.40 to 1.50% manganese, and one or more elements selected from the group of 0.05 to 2.00% chromium, 0.01 to 0.30% molybdenum, 0.02 to 0.10% vanadium, 0.002 to 0.01% niobium and 0.1 to 2.0% cobalt, into a semi-finished breakdown, continuously finish rolling the breakdown while the surface temperature thereof remains between 850° and 1000° C. by giving three or more passes, with a reduction rate of 5 to 30% per pass and a time interval of not longer than 10 seconds between the individual passes, and cooling the finished rail from 700° C. or above to between 700° and 500° C. at a rate of 2° to 15° C. per second, thereby adjusting the grain size of the pearlite blocks and the mechanical properties of the rail.

7. A process for manufacturing a pearlitic steel rail of high wear resistance according to claim 5, in which carbon content is limited to between over 0.85 and 1.20% by weight.

8. A process for manufacturing a pearlitic steel rail of high toughness according to claim 5, in which carbon content is limited to between 0.60 and 0.85% by weight.

9. A pearlitic steel rail of high wear resistance according to claim 2, in which carbon content is limited to between over 0.85% and 1.20% by weight.

10. A pearlitic steel rail of high toughness according to claim 2, in which carbon content is limited to between 0.60 and 0.85% by weight, with an elongation of not less than 12% and a V notch Charpy impact value of not less than 25 J/cm$^2$ in the part where the grain diameter of pearlite blocks averages 20 to 50 um.

11. A process for manufacturing a pearlitic steel rail of high wear resistance according to claim 6, in which carbon content is limited to between over 0.85 and 1.20% by weight.

12. A process for manufacturing a pearlitic steel rail of high toughness according to claim 6 in which carbon content is limited to between 0.60 and 0.85% by weight.

* * * * *

UNITED STATES PATENT AND TRADEMARK OFFICE

CERTIFICATE OF CORRECTION

PATENT NO. : 5,658,400

DATED : August 19, 1997

INVENTOR(S) : K. UCHINO et al.

It is certified that error appears in the above-identified patent and that said Letters Patent is hereby corrected as shown below:

In Claim 1, Col. 8, line 59; Claim 2, Col. 9, line 7; Claim 4, Col. 9, line 16; and Claim 10, Col. 10, line 27, change "V" to --U--.

In Col. 1, line 43; Col. 2, lines 50 and 67, Col. 4, lines 27, 31 and 36; and Abstract, line 9, change "V" to --U--.

Signed and Sealed this

Thirtieth Day of March, 1999

*Attest:*

*Attesting Officer*

Q. TODD DICKINSON

*Acting Commissioner of Patents and Trademarks*